US005182252A

United States Patent [19]

Nagasawa et al.

[11] Patent Number: 5,182,252

[45] Date of Patent: Jan. 26, 1993

[54] FILM FOR A THERMAL TRANSFER INK RIBBON

[75] Inventors: Tsugio Nagasawa; Tadashi Shuto; Toshiaki Matsumoto; Hideo Sakuraya; Shoji Nishimoto, all of Uji, Japan

[73] Assignee: Unitika Ltd., Amagasaki, Japan

[21] Appl. No.: 622,794

[22] Filed: Dec. 5, 1990

[30] Foreign Application Priority Data

Dec. 12, 1989 [JP] Japan ..... 1-322992

[51] Int. Cl.[5] ..... B41M 5/035; B41M 5/26; B41M 5/38

[52] U.S. Cl. ..... 503/227; 428/195; 428/421; 428/422; 428/423.1; 428/447; 428/484; 428/520; 428/910; 428/913; 428/914

[58] Field of Search ..... 428/195, 426, 422, 423.1, 428/447, 484, 488.1, 488.4, 520, 910, 913, 914; 8/471; 503/227

[56] References Cited

U.S. PATENT DOCUMENTS 4,572,860 2/1986 Nakamura et al. ..... 428/913
4,735,860 4/1988 Mizobuchi ..... 428/488.4

FOREIGN PATENT DOCUMENTS 105563 11/1990 Japan ..... 503/227

OTHER PUBLICATIONS

Patent Abstracts of Japan vol. 13, No. 247 (M-835) (3595) Jun. 8, 1989 & JP-A-01 56586 (Toray Industrial Co.) Mar. 3, 1989.

Patent Abstracts of Japan vol. 13, No. 244 (M-834) (3592) Jun. 7, 1989, & JP-A-01 51980 (Toray Industrial Co.) Feb. 28, 1989.

Patent Abstracts of Japan vol. 13, No. 206 (M-826) (3554) May 16, 1989, & JP-A-01 30787 (Konica Corp.) Feb. 1, 1989.

Patent Abstracts of Japan vol. 12, No. 78 (M-675) (2925) Mar. 11, 1988 & JP-A-62 218186 (Nitto Electric Industrial Co., Ltd.) Sep. 25, 1987.

*Primary Examiner*—Pamela R. Schwartz
*Attorney, Agent, or Firm*—Oblon, Spivak, McClelland, Maier & Neustadt

[57] ABSTRACT

A film for a thermal transfer ink ribbon having excellent heat stick resistance, which comprises a base film made of a biaxially stretched thermoplastic resin film and a thermally meltable ink layer or a thermally sublimable ink layer formed on one side of the base film, wherein a thin layer composed of (A) a thermally reactive urethane prepolymer, (B) a fluorine-type polymer resin having a perfluoralkyl group in its molecule, (C) a silicon-type compound having a hydroxyl group at each terminal of a dimethylpolysiloxane group, and (D) a polyvinyl alcohol having a saponification degree of at least 96 mol % and/or water-soluble starch, is formed on the other side of the base film at a rate of 0.05 to 0.5 $g/m^2$ as the total solid content of (A), (B), (C) and (D).

7 Claims, No Drawings

FILM FOR A THERMAL TRANSFER INK RIBBON

The present invention relates to a film for a thermal transfer ink ribbon and a process for its production.

Thermal transfer printers have now been widely used by virtue of their excellent properties such as operation efficiency, easiness of their maintenance and low level of noise production. They have also been developed for handy type or personal type. According to this recording method, a thermally meltable ink layer or a thermally sublimable ink layer is formed on a predetermined base film to obtain a thermal transfer film, then a recording sheet i.e. an ink receiving sheet is overlaid on the ink layer, a thermal head located on the opposite side is brought in contact with the heat transfer film and a platen roll is overlaid on the recording sheet and the thermal transfer film to press them with the thermal head. Then, a thermal pulse corresponding to a recording signal is imparted to the thermal head to finally selectively transfer the heat meltable ink layer or a heat sublimable ink layer to form a record image on the recording sheet. Otherwise, the thermally meltable ink layer is selectively melted, or the thermally sublimable ink is selectively sublimed to form a record image on the recording sheet. To conduct high speed recording by such a thermal transfer printing method, it is necessary to quickly raise the surface temperature of the thermal head in an extremely short period of time. Consequently, the base film of the thermal transfer ink ribbon will be subjected to a temperature exceeding the softening point, thus leading to a phenomenon (heat stick phenomenon) wherein a part of the base film is fused to the surface of the thermal head, whereby there will be defective printing or a trouble in transferring the thermal transfer ink ribbon. Thus, it becomes difficult to conduct high speed recording or accurate recording and to obtain high quality records.

Heretofore, it has been proposed to provide various heat resistant layers as a method for preventing such heat stick phenomenon. For example, Japanese Unexamined Patent Publication No. 169878/1984 discloses a case wherein cellulose acetate is coated in a thickness of from 0.5 to 5 μm as a heat resistant coating. However, this method requires a bonding layer, and it takes time for the coating. Besides, the thickness of the coating is substantial, which makes it difficult to obtain a long and compact thermal transfer ink ribbon. Japanese Unexamined Patent Publication No. 24995/1985 discloses a case wherein a hydrolyzate of an alkoxy silane is coated. It is recommended to employ a system wherein various catalysts, an organic solvent and colloidal silica are present, in order to effectively accelerate the hydrolysis reaction of the alkoxy silane. In this case, coating is conducted as a post coating method of an organic solvent type, whereby a number of process steps are required, and an expensive exprosion-preventive type is required for the coating and drying apparatus. In Japanese Patent Application No. 105563/1989, we have proposed a heat stick resistant coating film composed of a thermally reactive urethane polymer and/or a fluorine-type polymer resin having a perfluoroalkyl group, and a compound having a hydroxyl group at each terminal of a dimethylpolysiloxane group, as well as a process for its production. However, as the technology advances, the required levels for various properties including the heat stick resistance have been high, and such proposal has now been inadequate. The required properties may be summarized as follows:

(1) Heat stick preventing properties.

(2) The heat stick preventive layer should not migrate to the film surface or to the ink surface.

(3) The heat stick preventive layer should not stain the thermal head.

(4) The heat stick preventive layer should not abrade the thermal head.

(5) Low costs.

Particularly as a method for leveling up the heat stick is to use a silicone compound. Japanese Unexamined Pat Publication No. 137693/1985 recommends a method of coating silicone wax which is solid or liquid at room temperature, using a resin e.g. polyvinyl chloride or polyurethane having a softening point at least 200° C., as binder. In this case, the silicone wax is mixed with a certain specific resin binder and coated on a base film. However, mixing of such relatively low molecular weight silicone wax with a binder is not sufficient to prevent the migration of the silicone wax component to the film surface or to the ink surface after coating the ink.

Further, this method employs a post coating method of an organic solvent type and thus requires a coater of an exprosion-preventing type. Thus, the method is disadvantageous also from the viewpoint of running costs and costs for apparatus. Japanese Unexamined Patent Publication No. 219095/1985 proposes a method based on substantially the same technical concept in which a silicon-type or fluorine-type liquid surfactant is used as a lubricating substance of the heat stick resistant layer, and a cyclic aliphatic epoxy resin is used as the binder. Also in this case, no adequate performance is obtained for the prevention of the migration of the lubricating agent, and the method is a post coating method of an organic solvent type, whereby it is disadvantageous from the viewpoint of costs as mentioned above. Japanese Unexamined Patent Publication No. 35885/1987 discloses a still detailed method and defines the melting point of silicone oil. This is also a post coating method of an solvent type, whereby in addition to the above mentioned disadvantage from the viewpoint of the costs, there is a disadvantage that the thickness of the coating is as thick as 1 μm. Japanese Unexamined Patent Publication No. 33682/1987 discloses a case wherein a thin film of silicon-type rubber is alone coated on a support base film. However, the bonding strength with the base film is low, and it takes a long time for the curing reaction (for two minutes at 120° C in the Examples). Besides, the method is a post coating method of an organic solvent type, whereby it is disadvantageous from the viewpoint of costs.

It is an object of the present invention to overcome the sticking phenomenon which takes place during the heat transfer printing and to provide a film for a thermal transfer ink ribbon most suitable for heat transfer printers and the most suitable method for producing the film for a thermal transfer ink ribbon.

Thus, the present invention provides a film for a thermal transfer ink ribbon having excellent heat stick resistance, which comprises a base film made of a biaxially stretched thermoplastic resin film and a thermally meltable ink layer or a thermally sublimable ink layer formed on one side of the base film, wherein a thin layer composed of (A) a thermally reactive urethane prepolymer, (B) a fluorine-type polymer resin having a perfluoroalkyl group in its molecule, (C) a silicon-type compound having a hydroxyl group at each terminal of a dimethylpolysiloxane group, and (D) a polyvinyl alcohol having a saponification degree of at least 96 mol % and/or water-soluble starch, is formed on the other side of the base film at a rate of 0.05 to 0.5 g/m$^2$ as the total solid content of (A), (B), (C) and (D).

The present invention also provides a process for producing a film for a thermal transfer ink ribbon having excellent heat stick resistance, which comprises coating an aqueous emulsion or aqueous solution comprising (A) a thermally reactive urethane prepolymer, (B) a fluorine-type polymer resin having a perfluoroalkyl group in its molecule, (C) a silicon-type compound having a hydroxyl group at each terminal of a dimethylpolysiloxane group, and (D) a polyvinyl alcohol having a saponification degree of at least 96 mol % and/or water-soluble starch, on one side of a non-stretched or monoaxially stretched thermoplastic resin film, followed by drying, then simultaneously biaxially stretching the film or monoaxially stretching the film in a direction perpendicular to the first monoaxial stretching to attain perpendicular biaxial stretching, followed by heat setting to obtain a biaxially stretched film, and forming a thermally meltable ink layer or a thermally sublimable ink layer on the non-coated side of the biaxially stretched film.

Now, the present invention will be described in detail with reference to the preferred embodiments.

The thermally urethane polymer (A) to be used in the present invention, may be the one prepared as follows. Namely, it may be a thermally reactive urethane prepolymer containing freeisocyanate groups and having the freeisocyanate groups blocked with a bisulfite, prepared by an isocyanate polyaddition method from at least one compound containing at least two active hydrogen atoms and having a molecular weight of from 200 to 2,000 and an excess amount of polyisocyanate, and in some cases, a chain extender having active hydrogen atoms. Such urethane prepolymer may be used in the form of an aqueous uniform dispersion or uniform solution. Such thermally reactive urethane prepolymer has not only excellent affinity to water but also excellent affinity to the film. This is a characteristic which appears for the first time by selecting a molecular chain constituting urethane so that it has such usually opposing two properties and by blocking the isocyanate groups with a bisulfite. The thermally reactive property of this urethane prepolymer is a particularly important point in constituting the present invention.

In other words, when this thermally reactive urethane prepolymer (A) is coated as one of the components of the coating agent, the isocyanate groups blocked with a bisulfite will remain as blocked, or if unblocked, will remain unreacted, during the drying step of the coating layer and subsequent preheating and stretching steps, and it will be co-stretched together with the stretched film. The polymer having a perfluoroalkyl group can be held with adequate bonding strength at the surface of the thermoplastic resin film, while urethane of three dementional network structure containing dimethyl polysiloxane groups is formed by the reaction of the urethane prepolymer having isocyanate groups dissociated by the heat of high temperature level in the subsequent heat setting zone, with hydroxyl groups present at both terminals of the dimethylpolysiloxane groups, with hydroxyl groups of PVA and/or hydroxyl groups in the water-soluble starch molecules, or with PVAco groups having COOH groups in the molecule, or with other active hydrogen-containing groups, and by the crosslinking reaction of the urethane prepolymer itself.

Here, the compound having at least two active hydrogen atoms and having a molecular weight of from 200 to 2,000, may be a polymerization product of e.g. ethylene oxide, propylene oxide, styrene oxide or epichlorohydrin, a random or block copolymer thereof, or a polyether such as an addition polymer thereof to a polyhydric alcohol, a linear or branched polyester or polyether ester obtained from a polybasic saturated or unsaturated carboxylic acid or an acid anhydride thereof such as succinic acid, adipic acid, phthalic acid or malic anhydride and a polyhydric alcohol such as ethylene glycol, diethylene glycol, 1,4-butanediol, neopentyl alcohol, 1,6-hexanediol or trimethyrolpropane, a relatively low molecular weight polyethylene glycol or polypropylene glycol, or a mixture thereof.

The isocyanate which is reacted with such active hydrogen-containing compound to form the urethane prepolymer, may be toluylene diisocyanate, 4,4'-diphenyl methane diisocyanate, xylylene diisocyanate, isophorone diisocyanate, 4,4'-dicyclohexylmethane diisocyanate, hexamethylene diisocyanate or 2,2,4-trimethylhexamethylene diisocyanate.

The chain extender having active hydrogen atoms, may be ethylene glycol, diethylene glycol, 1,4-butanediol, 1,6-hexanediol, glycerol, trimethylolpropane, pentaerythritol, ethylenediamine, hexamethylenediamine, piperazine, monoethanolamine, diethanolamine, thiodiethylene glycol or water.

The fluorine-type polymer resin having a perfluoroalkyl group to be used in the present invention, may be the one containing a structure of the formula (I), (II) or (III) and containing other copolymer component selected from the group consisting of methacrylic acid, a methacrylate, an acrylate and styrene. However, it is not limited to such specific examples. Such resin may be used in the form of an aqueous dispersion or solution.

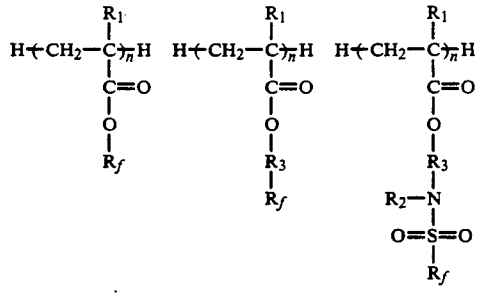

(I) (II) (III)

$R_1$: H or an alkyl group (carbon number: 1–20)
$R_2$: H or an alkyl group (carbon number: 1–20)
$R_3$: An alkylene group (carbon number: 1–20)
$R_f$: A perfluoroalkyl group (carbon number: 1–20)

The compound having a hydroxyl group at each terminal of a dimethylpolysiloxane group to be used in the present invention, contains a structure of the following formula, and the hydroxyl group is of a primary alcohol type.

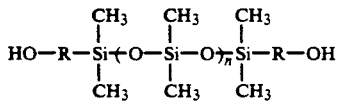

R: An alkylene group having at least one carbon atom n: A positive integer

When the average molecular weight is less than 500, this compound is readily soluble in water, but when used as a coating solution, the heat stick resistance of the final film tends to be inadequate. On the other hand, if the average molecular weight exceeds 5,000, the compound tends to be hardly soluble in water, whereby it becomes difficult to form an aqueous coating solution, and even if it is possibly coated, the reaction with the thermally reactive urethane prepolymer tends to be non-uniform and will not smoothly proceed.

The polyvinyl alcohol (PVA) to be used in the present invention must have a saponification degree of at least 96 mol %. Particularly preferably, the saponification degree is at least 98 mol %. If the saponification degree is low, the crystallinity of PVA is low, whereby the heat resistance and water resistance of the coating film formed by the present invention tend to be poor. Further, the heat stick resistant film finally formed will have excellent heat resistance and water resistance, coupled with the reaction of the reactive urethane prepolymer used in the present invention with hydroxyl groups (hereinafter referred to as OH groups) of the PVA molecular chains. Further, as a secondary property of PVA, if the degree of polymerization exceeds 2,000, the viscosity of a solution containing PVA tends to be high, whereby handling tends to be difficult.

According to the present invention, it is possible to realize higher levels of heat stick resistance and storage stability than those obtained by Japanese Patent Application Number 105563/1989. The PVA having a high saponification degree introduced anew in the present invention has a high rate of OH groups in its molecule. By the presence of OH groups in the PVA molecule, the coating film made of such PVA molecules will be oriented by the stretching and heat treatment steps during the process for production according to the present invention. By virtue of the hydrogen bonds among OH groups of the PVA molecules, a coating film having high crystallinity and excellent heat resistance and water resistance can be formed. Further, in an amorphous region of PVA molecular chains, the thermally reactive urethane prepolymer penetrates, whereby OH groups of the PVA molecular chains and CNO groups of the thermally reactive urethane prepolymer are reacted, and PVA molecular chains will be crosslinked. Thus, it is possible to form a coating film having the heat resistance and water resistance provided by the PVA molecules themselves further advanced.

In the present invention, the ratio of OH groups to CNO groups in the coating material system is also important. Particularly, it is preferred that the ratio of OH groups of the reactive silicone diol to CNO groups of the thermally reactive urethane prepolymer (OH silicone diol/CNO) is less than 0.75. If this ratio is 0.75 or more, the reactive silicone diol tends to remain unreacted in the coating film and create problems such as stickiness of the coating layer and the migration from the layer. The reaction of the reactive silicone diol with CNO groups of the thermally reactive urethane prepolymer proceeds preferentially over OH groups in the PVA molecular chains. The reaction mechanism is considered to be such that as mentioned above, the majority of OH groups in the PVA molecules having a high saponification degree tend to preferentially form hydrogen bonds with OH groups in other PVA molecular chains present in their vicinities, and OH groups in the PVA molecular chains remained in the amorphous portions will then react with CNO groups of the thermally reactive urethane prepolymer to crosslink PVA molecules. It is believed that prior to this reaction at the amorphous portions, the reaction of the reactive silicone diol with the thermally reactive urethane prepolymer takes place. Such crystallization and crosslinking reactions proceed subsequent to the stretching in the process for producing the film, particularly in the heat treatment step.

As the water-soluble starch to be used in the present invention, soluble starch, etherified starch, esterified starch or other modified starch may be mentioned. If it is attempted to dissolve usual starch in water, even if starch is heated in water, there will be no change in the shape or size of starch particles at a temperature of not higher than 50° C., and starch particles will be simply dispersed in water. If the temperature is raised, starch particles start to swell abruptly from a certain temperature and then dissolve in water. Such a temperature is usually from 60° to 90° C. Whereas, water-soluble starch to be used in the present invention is adequately soluble at a temperature of about 40° C. and the viscosity of the solution is usually lower as compared with usual starch. Thus, the nature of the water-soluble starch is different from usual starch, and when heated with water, it does not form a paste and forms a transparent solution.

Now, each of the above mentioned water soluble starches will be described.

Soluble starch is produced mainly by the following two methods.

(1) A method of hydrolyzing starch under a mild condition by means of a mineral acid such as hydrochloric acid or sulfuric acid.

(2) A method of gently oxidizing starch by means of e.g. sodium hypochlorite.

In the product prepared by the method (1), starch molecules are non-homogeneously hydrolyzed. Oligosaccharide obtainable by further conducting this reaction may be included in the water-soluble starch of the present invention. The soluble starch produced by the method (2), may be regarded as a kind of oxidized starch which has been made soluble in water by the introduction of carbonyl groups by oxidation of glucose residues which are repeating units of the starch molecular structure, although hydrolysis of the glucoside bonds in the starch molecules also takes place.

The etherified starch is the one wherein a part of hydroxyl groups of glucose residues constituting the starch molecules is etherified by e.g. a ring-opening addition reaction of an epoxy ring and includes, for example, a hydroxyalkyl ether, an aminoalkyl ether, a quaternary ammonium ether and a carboxyalkyl ether.

As the esterified starch, a phosphoric acid ester is typical.

Further, a modified starch obtained by reacting starch with urea may also be used as the water-soluble starch of the present invention.

However, it should be understood that the water-soluble starch is not limited to the above mentioned specific examples. The water-soluble starch introduced anew by the present invention contains many OH groups in its molecule. The coating film made of such water-soluble starch molecules will be oriented and crystallized by the stretching and heat treatment steps in the process for production. The crystallization is further promoted by the hydrogen bonds among OH groups of starch molecules, whereby a coating film excellent in the heat resistance and water resistance will be formed.

Further, into the amorphous region of the starch molecules, the thermally reactive urethane prepolymer penetrates. In this amorphous region, there exist hydrogen bonds among OH groups of the starch molecular chains, or among COOH groups, $NH_2$ groups, etc. of the modified starch. Not only that, such active hydrogen-containing groups react with CNO groups of the thermally reactive urethane prepolymer to crosslink the starch molecular chains. Thus, it is possible to further level up the heat resistance and water resistance provided by the water soluble starch only.

In other words, the ratio of OH groups to CNO groups is defined in the same manner as in the case of above mentioned PVA, and it can be said that the reaction of OH groups of the reactive silicone diol with CNO groups of the thermally reactive urethane prepolymer preferentially proceeds over the reaction of OH groups of the starch molecular chains. The reaction scheme is as mentioned above. Namely, the majority of OH groups in the water soluble starch molecular chains interact firmly by hydrogen bonds with OH groups of starch molecular chains present in their vicinities, to form fine crystals. OH groups, COOH groups, $NH_2$ groups, etc. in the starch molecular chains remained in the amorphous portions may form hydrogen bonds among them, but react with CNO groups of the thermally reactive urethane prepolymer (remaining after the reaction of the thermally reactive urethane prepolymer with the reactive silicone diol) to crosslink starch molecules.

Further, PVAco having COOH groups in its molecule covered by the present invention is a copolymer containing in the molecular chain of PVA a copolymer component having a COOH group such as acrylic acid, malonic acid or itaconic acid, or a carboxyl metal salt thereof as the copolymer component. The relation between the saponification degree x of this PVAco, the COOH group-modified copolymer component y and the number k of COOH groups contained in the copolymer component unit, is required to satisfy the following conditions (1), (2) and (3).

$$x \geqq 85 \quad (1)$$

$$0 < y \leqq 15 \quad (2)$$

$$x + ky \geqq 96 \quad (3)$$

The saponification degree x is preferably at least 85 mol %. If it is less than 85 mol %, PVAco tends to have low crystallinity, and when used as coating material of the present invention, the basic performance for the heat stick resistance tends to be poor. The copolymer modification rate y of PVAco containing COOH groups or their metal salts is at most 15 mol %. If the modification rate exceeds 15 mol %, PVAco tends to have low crystallinity, and when used as a coating material of the present invention, the basic performance for the heat stick resistance tends to be poor in the same fashion as mentioned with respect to the saponification degree.

Further, the saponification degree x, the copolymer modification rate y and the number k of COOH groups or carboxyl metal salt groups (hereinafter referred to as COOX groups) in the copolymer component unit, preferably satisfy the formula (III). If x+ky is less than 96, PVAco tends to have low crystallinity again, and when used as a coating material of the present invention, the basic performance for the heat stick resistance tends to be poor. Further, if the polymerization degree of PVAco exceeds 2,000, the viscosity of the solution having PVAco dissolved therein tends to be high, whereby handling tends to be difficult. According to the present invention, it is possible to realize the heat stick resistance and storage stability more advanced over those attainable by Japanese Patent Application No. 105563/1989. The coating film composed of PVAco molecules will be oriented and crystallized by the stretching and heat treatment during the process of the present invention.

Namely, by the presence of OH groups in the PVAco molecules, the crystallinity will be high by the hydrogen bonds among OH groups of the PVAco molecules, whereby a coating film excellent in the heat resistance and water resistance will be formed. Further, COOH groups or COOX groups in the PVAco molecules establish hydrogen bonds, ion bonds or chemical bonds by dehydration reaction, with OH groups, COOH groups or COOX groups present in their vicinity, which coupled with the hydrogen bonds among the above mentioned OH groups, provide a coating film excellent in the heat resistance and water resistance. Into the amorphous region of the PVAco molecules, the copolymer component and the thermally reactive urethane prepolymer penetrate, and OH groups and COOH groups of the PVAco molecular chains react with CNO groups of the thermally reactive urethane prepolymer, whereby PVAco molecules are crosslinked, and the heat stick resistant coating film obtained by the present invention will have excellent heat resistance and water resistance.

The ratio of OH groups to CNO groups is defined in the same fashion as in the case of the above mentioned PVA or starch. The reason why the reaction of OH groups in the reactive silicone diol with CNO groups in the thermally reactive urethane prepolymer preferentially proceeds over OH groups or COOH groups in the PVAco molecular chains, is not clearly understood, but may be explained as follows.

Namely, as mentioned above, the majority of OH groups in the PVAco molecular chains establish hydrogen bonds with OH groups of the molecular chains present in their vicinity, to form fine crystals. Among OH groups, COOH groups and COOX groups of the PVAco molecular chains left at the amorphous portions, hydrogen bonds, ion bonds and chemical bonds are formed, and OH groups and COOH groups are reacted with CNO groups of the thermally reactive urethane prepolymer (left from the reaction with the reactive silicone diol) to crosslink the PVAco molecular chains.

To the coating material of the present invention, a stabilizer for the coating solution, an inorganic inactive fine powder for adjusting lubricating properties, an antistatic agent, etc. may be incorporated as the case requires to the extent not to impair the function of the coating material. The heat stick resistant coating material of the present invention provides sufficient effects with a thin layer and is coated in an amount of from 0.05 to 0.5 g/m$^2$, preferably from 0.1 to 0.3 g/m$^2$, has solid content. If the amount of coating is extremely large beyond 0.5 g/m$^2$, cracking is likely to take place in the coating layer in the drying step after the coating, and consequently peeling of the coating layer tends to be likely to take place. On the other hand, if the amount of coating is less than 0.05 g/m$^2$, the stick preventing effects tend to be inadequate.

The proportions of the respective components in the coating material of the present invention are defined to obtain the desired heat stick resistance. Namely, of 110 parts by weight of the total of four components (A), (B), (C) and (D), component (A) is at least 70 parts by weight, component (B) is at least 20 parts by weight, component (C) is at least 10 parts by weight, and component (D) is at most 10 parts by weight and not nil. The four components (A), (B), (C) and (D) are essential components, and within the respective ranges, the proportions may be adjusted within the total of 110 parts by weight.

Now, a process for producing a thermal transfer film of the present invention will be described. As the thermal transfer film of the present invention, it is of course possible to use a coating film obtained by a so-called post coating method wherein the above mentioned specific coating material is coated on a biaxially stretched thermoplastic film. However, according to the process of the present invention, in order to apply the coating with the required minimum thickness uniformly and at a low cost, an in-line coating method is adopted wherein coating is applied to a so-called non-stretched film obtained by melt-extruding a thermoplastic resin in the form of a film and the coated film is simultaneously biaxially stretched, or the above mentioned non-stretched film is preliminarily stretched in one direction i.e. in the longitudinal or transverse direction, then coating is applied to the monoaxially stretched film, and then the base film and the coating layer are simultaneously stretched in the longitudinal and transverse directions simultaneously or in the direction perpendicular to the direction of the preliminary stretching, and such a process is most suitable as a process for producing a uniform thin film with good productivity.

In this manner, a film having excellent adhesiveness of the coating layer to the base film, is obtainable. There is no particular restriction as to the coating method, and it is possible to employ a gravure roll coating method, an inverse roll coating method, a reverse roll coating method, a Maiyer bar coating method or an air knife coating method. The coating layer and the base film are co-stretched and then subjected to heat treatment, whereby heat dimensional stability adequately durable in the subsequent film processing steps will be imparted.

The most remarkable feature of the present invention is that the stick preventive layer can be formed by inline coating without application of anchoring treatment to the base film. The reason why it is possible to form a coating excellent in the adhesion to the base film and excellent in the heat stick resistance without anchor coating, may be attributable to the reaction mechanism of the coating material constituting the coating solution and to the molecular structures of the compounds constituting the coating composition.

Namely, the thermally reactive urethane prepolymer to be used in the present invention is designed so that the reactivity of the blocked isocyanate groups contained in the molecules is regained by heat, but it remains blocked during the drying, preheating and stretching steps and in the heat setting step, proceeds with the reaction with the reactive silicone diol and with the self crosslinking reaction. To promote such reactions, a catalyst made of a tertiary amine or an organic metal compound may be employed.

The thermally reactive urethane prepolymer has not only the base polymer but also a molecular moiety composed of a hydrocarbon having high affinity with the main chain of the fluorine-type polymer resin having a perfluoroalkyl group. Further, the fluorine-type polymer resin having a perfluoroalkyl group also contains a hydrocarbon in the main chain, and this moiety has a strong interaction with the hydrocarbon moiety of the thermally reactive urethane prepolymer and exhibits a strong interaction also with the hydrocarbon moiety of the base film.

Further, the reactive silicone diol reacts, as mentioned above, with the isocyanate groups of the thermally reactive urethane prepolymer to bond to the urethane, whereby the thermally reactive urethane is converted to a silicone-modified urethane polymer resin, which in turn provides a strong interaction with hydrocarbon moieties of the base film and the thermally reactive urethane prepolymer. PVA having a high saponification degree forms a coating film highly crystallized due to OH groups present in a high concentration in the molecules, whereas OH groups remaining in the amorphous portions are reacted with CNO groups in the thermally reactive urethane prepolymer to crosslink PVA molecules and consequently to form a coating film having high crystallinity and excellent heat resistance and water resistance, which is firmly bonded also to the base film by a strong interaction between methylene groups in the PVA molecules and the hydrogen bonds of the hydrocarbon in the urethane polymer bonded to PVA.

Further, the water-soluble starch forms a coating film highly crystallized by OH groups present at a high concentration in its molecular chains, whereas OH groups remaining in the amorphous portions react with CNO groups of the thermally reactive urethane prepolymer to crosslink starch molecules, whereby a coating film having high crystallinity and excellent heat resistance and water resistance can be formed, and the starch molecules reacted with the thermally reactive urethane prepolymer are strongly bonded by the strong interaction between the hydrocarbon moieties in the urethane polymer and the base film.

Further, PVAco having COOH groups forms a coating film highly crystallized by hydrogen bonds due to OH groups present in a high density in its molecules. By the chemical bond by dehydration between the OH groups and COOH groups remained in the amorphous portions, by the hydrogen bonds or ion bonds among OH groups, COOH groups and COOX groups and by the crosslinking of the PVAco molecular chains by the reaction of OH groups or COOH groups with CNO groups of the thermally reactive urethane prepolymer, a coating film having high crystallinity and excellent heat resistance and water resistance will be formed.

By such reasons, the composition constituting the coating material has a strong interaction with the base film. At the same time, in the coating material, the thermally reactive urethane prepolymer and the reactive silicone diol are bonded to each other by the mutual chemical bond, and PVA and/or water-soluble starch react with COOH groups and the thermally reactive urethane prepolymer and also with the polymer resin having a perfluoroalkyl group three dimensionally to form a network structure and to bond the base film to form a strong coating film. By this coating film, it is possible to obtain a film useful as a thermal transfer ink ribbon having excellent heat stick resistance.

As the thermally meltable ink to be used in the present invention, conventional transfer inks may be employed. As the wax, carnauba wax, briquette wax, bee wax, micro wax, paraffin wax or the like is employed, and as a coloring substance, carbon black, cyanine blue, lake red, phthalocyanine blue, cadmium yellow, zink oxide or the like may be employed. Such materials are mixed to obtain a thermal transfer ink having a necessary color. Then, the ink is applied by a hot melt coating method or a solvent coating method to provide an ink layer of from 1 to 10 g/m$^2$ on the other side of the stick preventive layer of the base film. The thermally sublimable ink layer of the present invention comprises a thermally sublimable dye and a binder. The dye contained in this layer is a disperse dye having a molecular weight of from 150 to 400.

The binder resin may be a cellulose resin such as ethyl cellulose, hydroxyethyl cellulose, ethylhydroxy cellulose, hydroxypropyl cellulose, methyl cellulose, cellulose acetate or nitro cellulose, a vinyl resin such as PVA, polyvinyl acetal, polyvinyl butyral, polyvinyl acetate, polyvinyl pyrrolidone or polyacrylamide or various polyester resins. This thermally sublimable ink layer is formed by a solvent coating method in a thickness of from 0.2 to 5.0 g/m$^2$ on the opposite side of the stick preventive layer of the base film.

Now, the present invention will be described in further detail with reference to Examples and Comparative Examples. However, it should be understood that the present invention is by no means restricted by such specific Examples.

EXAMPLES 1 to 3 and COMPARATIVE EXAMPLES 1 to 3

On a non-stretched polyethylene terephthalate film having a thickness of 70 μm, an aqueous mixture prepared to have a composition as identified in Table 1 by using an aqueous solution of a thermally reactive urethane prepolymer (Elastron H-3, trade name, manufactured by Daiichi Kogyo Seiyaku K.K., solid content: 20 wt. %), PVA (Unitika Poval, UMR-10HH, UF-050G, UF-050MG, UP-050G, trade manes, manufactured by Unitika Chemical K.K.), an aqueous emulsion of a perfluoroacrylate resin (Asahi Guard LS-317, trade name, manufactured by Asahi Glass Company Ltd., solid content: 20 wt. %), an alcohol-modified silicone (DK Q8-779, trade name, manufactured by Daw Corning Company) and water, was coated by a bar coater and dried at 60° C. Then, the coated film was simultaneously biaxially stretched 3.5 times in each of the longitudinal and transverse directions and then subjected to heat setting at 215° C. for 5 seconds. The heat stick preventive coating of the obtained polyester base film having a thickness of 5.7 μm had a thickness of 0.2 g/m$^2$. On the opposite side of the heat stick preventive coating, a thermally meltable ink layer comprising paraffin wax, carbon black, etc. was coated in a thickness of 3 g/m$^2$ to obtain a thermal transfer ink ribbon.

This ribbon was subjected to printing tests by printing on a normal paper and on an OHP film (hereinafter referred to simply as OHPF) with the maximum thermal head output by Panacopy FNP-300 manufactured by Matsushita Electric Industrial Co., Ltd. Further, in order to evaluate the migration of the heat stick preventive coating component, a film roll before coating the ink layer was stored at 70° C. for 24 hours, and the wetting index on the film surface was measured and evaluated on the basis that less than 36 erg/cm$^2$ was evaluated to be "no good" and 36 erg/cm$^2$ or more was evaluated to be "good". The results are shown in Table 1.

TABLE 1

| | | Example 1 | Example 2 | Example 3 | Comparative Example 1 | Comparative Example 2 | Comparative Example 3 |
|---|---|---|---|---|---|---|---|
| Composition | Elastron H-3 | 70 | 70 | 70 | 70 | 70 | 70 |
| | Trade name | UMR-10HH | UMR-30HH | UF-050G | UF-050MG | UP-050G | |
| | Unitika Poval | at least 98 mol % | at least 98 mol % | 98–99 mol % | 94–95 mol % | 87–89 mol % | |
| | Saponification degree | 10 | 10 | 10 | 10 | 10 | 0 |
| | Asahi Guard LS-317 | 20 | 20 | 20 | 20 | 20 | 20 |
| | DK Q8-779 | 10 | 10 | 10 | 10 | 10 | 10 |
| Coating properties | | Good | Good | Good | Good | Good | Good |
| Evaluation of stick properties | Printing on normal paper | Smooth printing | Smooth printing | Smooth printing | Smooth printing | Sticking during printing | Sticking during printing |
| | Printing on OHPF | Smooth printing | Smooth printing | Smooth printing | Smooth printing | Slight sticking during printing | Slight sticking during printing |
| Storage test | | Good | Good | Good | Good | No good | No good |

In Comparative Example 1, PVA having a saponification degree of from 94 to 95 mol % and a molecular weight of about 27,000 was used. In Comparative Example 2, PVA having a saponification degree of from 87 to 89 mol % and a molecular weight of about 27,000 was used. In Comparative Example 3, PVA was not used.

In Example 1, PVA having a saponification degree of at least 98 mol % and a molecular weight of about 11,000 was used. In Example 2, PVA having a saponification degree substantially the same as in Example 1 at a level of at least 98 mol % and a molecular weight of about 24,000 was used. In Example 3, PVA having a saponification degree of from 98 to 99 mol % and a molecular weight of about 27,000 was used.

In Comparative Examples 1 and 2 wherein the saponification degree of PVA was less than 96 mol %, the heat stick resistance is low as compared with Examples 1, 2 and 3 where PVA having a saponification degree of at least 96 mol % was used. Comparative Examples 1 and 3 wherein no PVA was used, are found to be ranking at low levels with respect to each of the heat stick resistance and the storage stability even among the Comparative Examples.

EXAMPLES 4 and 5 and COMPARATIVE EXAMPLES 4 and 5

A film having 0.2 g/m$^2$ of a heat stick preventive coating applied on a base film having a thickness of 3.5 μm, was prepared under the same conditions as in Example 1 except that on a non-stretched polyethylene terephthalate film having a thickness of 43 μm, a coating having the same composition as in Example 1 was applied by varying the thickness from 0.03 to 0.7 g/m$^2$. On the side opposite to the heat stick preventive coating, a thermally meltable ink comprising paraffin wax, carbon, etc. was coated in a thickness of 3 g/m$^2$ to obtain a thermal transfer ink ribbon. This ribbon was subjected to printing tests by printing on normal paper and on OHPF with the maximum thermal head output by Canoword PEN-24 manufactured by Canon Inc. Further, the evaluation of the migration of the heat stick preventive coating component was conducted in the same manner as in Example 1. The results are shown in-Table 2.

TABLE 2

| | | Example 4 | Example 1 | Example 5 | Comparative Example 4 | Comparative Example 5 |
|---|---|---|---|---|---|---|
| The thickness of the coating g/m$^2$ | | 0.05 | 0.2 | 0.5 | 0.03 | 0.7 |
| Composition | Elastron H-3 | 70 | 70 | 70 | 70 | 70 |
| | Unitika Poval UMR-10HH | 10 | 10 | 10 | 10 | 10 |
| | Asahi Guard LS-317 | 20 | 20 | 20 | 20 | 20 |
| | DK Q8-779 | 10 | 10 | 10 | 10 | 10 |
| Coating properties | | Good | Good | Good | Good | Cracking observed in coating |
| Evaluation of stick properties | Printing on normal paper | Smooth printing | Smooth printing | Smooth printing | Smooth printing | Not tested |
| | Printing on OHPF | Smooth printing | Smooth printing | Smooth printing | Slight sticking during printing | Not tested |
| Storage test | | Good | Good | Good | Good | Good |

In comparative Example 3 wherein the thickness of the coating is as thin as 0.3 g/m$^2$, heat sticking tends to take place particularly when printing is made on OHPF, although there is no particular problem when printing is made on paper. In this respect, Comparative Example 4 is inferior to Examples 4, 5 and 6. On the other hand, in Comparative Example 5 wherein the thickness of the coating is as thick as 0.7 g/m$^2$, the coating is so thick that cracking was observed at part of the coating.

EXAMPLE 6

A non-stretched polyethylene terephthalate film having a thickness of 91 μm was stretched 1.3 times in the longitudinal direction at 90° C., and then coating and drying were conducted in the-same manner as in Example 2. Thereafter, the coated film was simultaneously biaxially stretched 3.5 times in each of the longitudinal and transverse directions at 100° C. and then subjected to heat setting at 215° C. for 5 seconds. On the polyethylene terephthalate base film having a thickness of 5.7 μm thus obtained, a heat stick preventive coating having a thickness of 0.2 g/m$^2$ was applied to obtain a film. Then, a thermal transfer ink ribbon was prepared and the property evaluation was conducted in the same manner as in Example 2. As a result, printing was excellent without sticking. On the other hand, the result of the storage test was also good.

EXAMPLE 7

A non-stretched polyethylene terephthalate film having a thickness of 70 μm was stretched 3.5 times in the longitudinal direction at 90° C., and then, coating and drying were conducted in the same manner as in Example 2. Then, the film was stretched 3.5 times in the transverse direction at 110° C. and subjected to heat setting at 215° C. for 5 seconds. On the polyethylene terephthalate base film having a thickness of 5.7 μm thus obtained, a heat stick preventive coating was applied in a thickness of 0.2 g/m$^2$ to obtain a film. Further, a thermal transfer ink ribbon was prepared and the property evaluation was conducted in the same manner as in Example 2. As a result, printing was excellent without sticking, and the result of the storage test was also good.

EXAMPLE 8

A thermally sublimable ink ribbon was prepared in the same manner as in Example 7 except that a thermally sublimable ink was coated in a thickness of 1.5 g/m$^2$. Here, the thermally sublimable ink was the one comprising a disperse dye and a polyvinyl butyral resin.

EXAMPLES 9 to 12 and COMPARATIVE EXAMPLES 6 and 7

On the same film as used in Example 1, an aqueous mixture prepared to have a composition as identified in Table 3 by using an aqueous solution of a thermally reactive urethane prepolymer (Elastron H-3, trade name, manufactured by Daiichi Kogyo Seiyaku K.K., solid content: 20 wt. %), starch (trade name: Stabilose S-10, trade name: Nylgum A-55, trade mane: Pinedex #100, trade name: Uniquegum RC, trade name: Kikyo, manufactured by Matsutani Kagaku Kogyo K.K., trade name: Avelex 2530, manufactured by Avebe Company), an aqueous emulsion of a perfluoroacrylate resin (trade name: Asahi Guard, LS-317, solid content: 20 wt. %, manufactured by Asahi Glass Company Ltd.), an alcohol-modified silicone (trade name: DK Q-779, manufactured by Daw Corning Company) and water, was coated by a bar coater and then dried at 60° C. the coated film was simultaneously biaxially stretched 3.5 times in each of the longitudinal and transverse directions at 90° C. Then, heat setting was conducted at 215° C. for 5 seconds. On the polyethylene terephthalate base film having a thickness of 5.7 μm thus obtained, a heat stick preventive coating was applied in a thickness of 0.2 g/m². On the side opposite to the heat stick preventive coating, a thermally meltable ink layer comprising paraffin wax, carbon black, etc. was coated in a thickness of 3 g/m² to obtain a thermal transfer ink ribbon. The results are shown in Table 3.

TABLE 3

| | | Example 9 | Example 10 | Example 11 | Example 12 | Comparative Example 6 | Comparative Example 7 |
|---|---|---|---|---|---|---|---|
| Composition | Elastron H-3 | 70 | 70 | 70 | 70 | 70 | 70 |
| | Name of Starch | Stabilose S-10 | Nylgum A-55 | Avelex 2530 | Pinedex #100 | Uniquegum RC | Kikyo |
| | Saponification degree | 10 | 10 | 10 | 10 | 10 | 10 |
| | Asahi Guard LS-317 | 20 | 20 | 20 | 20 | 20 | 20 |
| | DK Q8-779 | 10 | 10 | 10 | 10 | 10 | 10 |
| Coating properties | | Good | Good | Good | Good | Good | Good |
| Evaluation of stick properties | Printing on normal paper | Smooth printing | Smooth printing | Smooth printing | Smooth printing | Sticking during printing | Sticking during printing |
| | Printing on OHPF | Smooth printing | Smooth printing | Smooth printing | Smooth printing | Slight sticking during printing | Slight sticking during printing |
| Head dust | | Nil | Nil | Nil | Nil | Present | Present |
| Storage test | | Good | Good | Good | Good | No good | No good |

Stabilose S-10 used in Example 9 was prepared from tapioca starch as raw material by subjecting it oxidation treatment with sodium hypochlorite to convert it to soluble starch. Nylgum A-55 used in Example 10 was the one obtained by esterifying and modifying a part of hydroxyl groups of the glucose residues of the starch with phosphoric acid and urea. Avelex 2530 used in Example 11 was one obtained by converting a part of hydroxyl groups of the glucose residues of the starch to hydropropyl ether. Pinedex #100 used in Example 12 was the one obtained by hydrolyzing usual starch to reduce the polymerization degree to a level of about 30 with glucose residues as repeating units. Whereas, Uniquegum RC used in Comparative Example 6 is a cornstarch type starch and its average particle size was 13.5 μm. Further, Kikyo used in Comparative Example 7 was starch of U.S. type and its average particle size was 4.7 μm.

The starches used in Examples 9 to 12 were all made into aqueous solutions by dissolving 20 % by weight of the solid content in water at 40° C. After cooling the aqueous solutions to room temperature, they were adjusted to the compositions of the final coating solutions, whereby no change such as no precipitation was observed. On the other hand, the starches employed in Comparative Examples 6 and 7 did not dissolve in water at 40° C. and were dispersed in water. Such dispersions were cooled to room temperature and used as coating solutions. However, when such coating solutions were left to stand still, starch particles tended to sediment and were difficult to use.

As is evident from Table 3, Examples 9 to 12 wherein water-soluble starches were employed, were superior to Comparative Examples 6 and 7 with respect to every item of evaluation.

EXAMPLES 13 and 14 and COMPARATIVE EXAMPLES 8 to 10

A film having a heat stick preventive coating applied in a thickness as identified in Table 4 on a base film having a thickness of 3.5 μm, was prepared in the same manner as in Example 10 except that on a non-stretched polyethylene terephthalate film having a thickness of 43 μm, a coating having the same composition as in Example 10 was applied by varying the thickness from 0.03 to 0.7 g/m². Coating of an ink was conducted in the same manner as in Example 10. The ribbon thereby obtained was subjected to printing tests by printing on normal paper and on OHPF with the maximum thermal head output by Canoword PEN-24 manufactured by Canon Inc. The evaluation of the presence or absence of deposition of dust after printing and the evaluation of migration of the heat stick preventive coating component were conducted in the same manner as in Example 10.

Comparative Example 8 wherein the thickness of the coating was as thin as 0.03 g/m², showed a tendency for sticking when printing was made on OHPF. In this regard, this Comparative Example 8 is inferior to Examples 9, 13 and 14. On the other hand, Comparative Example 9 wherein the thickness of the coating was so thick as 0.7 g/m², the coating was so thick that cracking was observed at a part of the coating. Further, in Comparative Example 10 wherein water-soluble starch was not used, slight sticking was observed when printing was made on OHPF, although there was no problem when the printing was made on normal paper, and the storage stability was also inferior. The results are shown in Table 4.

TABLE 4

| | | Example 13 | Example 9 | Example 14 | Comparative Example 8 | Comparative Example 9 | Comparative Example 10 |
|---|---|---|---|---|---|---|---|
| The thickness of the coating g/m² | | 0.05 | 0.2 | 0.5 | 0.03 | 0.7 | 0.2 |
| Composition | Elastron H-3 | 70 | 70 | 70 | 70 | 70 | 80 |
| | Nylgum A-55 | 10 | 10 | 10 | 10 | 10 | 0 |
| | Asahi Guard LS-317 | 20 | 20 | 20 | 20 | 20 | 20 |
| | DK Q8-779 | 10 | 10 | 10 | 10 | 10 | 10 |

TABLE 4-continued

| | | Example 13 | Example 9 | Example 14 | Comparative Example 8 | Comparative Example 9 | Comparative Example 10 |
|---|---|---|---|---|---|---|---|
| Coating properties | | Good | Good | Good | Good | Cracking observed in coating | Good |
| Evaluation of stick properties | Printing on normal paper | Smooth printing | Smooth printing | Smooth printing | Smooth printing | Not tested | Smooth printing |
| | Printing on OHPF | Smooth printing | Smooth printing | Smooth printing | Slight sticking during printing | Not tested | Sticking during printing |
| | Head dust | Nil | Nil | Nil | Nil | Not tested | Nil |
| | Storage test | Good | Good | Good | Good | Good | No good |

EXAMPLE 15

A non-stretched polyethylene terephthalate film having a thickness of 91 μm was stretched 1.3 times in the longitudinal direction at 90° C., and then coating and drying were conducted in the same manner as in Example 10. Thereafter, the coated film was simultaneously biaxially stretched 3.5 times in each of the longitudinal and transverse directions at 100° C. and then subjected to heat setting at 215° C. for 5 seconds. Thus, a heat stick preventive coating having a thickness of 0.2 g/m$^2$ was applied on a polyethylene terephthalate film of 5.7 μm, and a thermal transfer ink ribbon was prepared in the same manner as in Example 10, and the property evaluation was conducted. As a result, printing was excellent without sticking, no deposition of head dust was observed, and the result of the storage test was also good.

EXAMPLE 16

A non-stretched polyethylene terephthalate film having a thickness of 70 μm was stretched 3.5 times in the longitudinal direction at 90° C., and then coating and drying were conducted in the same manner as in Example 10. Then, the film was stretched 3.5 times in the transverse direction at 110° C. Further, the stretched film was subjected to heat setting at 215° C. for 5 seconds to obtain a film having a heat stick preventive coating applied in a thickness of 0.2 g/m$^2$ on a polyethylene terephthalate film having a thickness of 5.7 μm. Further, in the same manner as in Example 10, the property evaluation as a thermal transfer ink ribbon was conducted. As a result, printing was excellent without sticking, no deposition of head dust was observed, and the result of storage test was also excellent.

EXAMPLE 17

Instead of the thermally meltable ink in Example 16, a thermally sublimable ink was coated in a thickness of 1.5 g/m$^2$, and using the ink ribbon thereby obtained, a portrait was printed out by video printer VY-200 manufactured by Hitachi, Ltd. to evaluate the performance, whereby no sticking was observed, and the image thereby obtained was clear. The thermally sublimable ink used here was the one comprising a disperse dye, a polyvinyl butyral resin, etc.

EXAMPLES 18 to 20 and COMPARATIVE EXAMPLES 11 to 13

Thermal transfer ink ribbons were prepared in the same manner as in Example 1. The results are shown in Table 5.

TABLE 5

| | | Example 18 | Example 19 | Example 20 | Comparative Example 11 | Comparative Example 12 | Comparative Example 13 |
|---|---|---|---|---|---|---|---|
| The thickness of the coating g/m$^2$ | | 0.05 | 0.2 | 0.5 | 0.2 | 0.03 | 0.7 |
| Composition | Elastron H-3 | 70 | 70 | 70 | 80 | 70 | 70 |
| | Unitika Poval | UFA-170 10 | UFA-170 10 | UFA-170 10 | 0 | UFA-170 10 | UFA-170 10 |
| | Asahi Guard LS-317 | 20 | 20 | 20 | 20 | 20 | 20 |
| | DK Q8-779 | 10 | 10 | 10 | 10 | 10 | 10 |
| Coating properties | | Good | Good | Good | Good | Good | Cracking observed in coating |
| Evaluation of stick properties | Printing on normal paper | Smooth printing | Smooth printing | Smooth printing | Sticking no printing | Smooth printing | Not tested |
| | Printing on OHPF | Smooth printing | Smooth printing | Smooth printing | Sticking during printing | Slight sticking during printing | Not tested |
| Storage test | | Good | Good | Good | No Good | Good | Good |

UFA-170 used in the Examples is PVA modified with about 2 mol % of malenic acid, which has a saponification degree of at least 96 mol % and a degree of polymerization of about 1,700. From the comparison of Example 19 containing UFA-170 with Comparative Example 11 not containing UFA-170, it is evident that Example 19 is superior to Comparative Example 11 in the evaluation of sticking properties and in the storage stability. From Examples 18 to 20 and Comparative Examples 12 and 13, it is apparent that the thickness of the heat stick resistant coating is preferably from 0.05 to 0.5 g/m$^2$. If the coating layer is thin, the sticking properties tend to be inferior, and if the coating layer is too thick, cracking tends to result in the coating.

EXAMPLE 21

A non-stretched polyethylene terephthalate film having a thickness of 91 μm was stretched 1.3 times in the longitudinal direction at 90° C., and then this longitudinally stretched film was coated and dried in the same manner as in Example 19. Thereafter, the coated film was simultaneously biaxially stretched 3.5 times in each of the longitudinal and transverse directions at 100° C. and then subjected to heat setting at 215° C. for 5 seconds. On the polyethylene terephthalate base film having a thickness of 5.7 μm thus obtained, a heat stick preventive coating having a thickness of 0.2 g/m$^2$ was applied to obtain a film. Then, a thermal transfer ink ribbon was prepared and the property evaluation was conducted in the same manner as in Example 19. As a result, printing was excellent without sticking. On the other hand, the result of the storage test was also good.

EXAMPLE 22

A non-stretched polyethylene terephthalate film having a thickness of 70 μm was stretched 3.5 times in the longitudinal direction at 90° C., and then this longitudinally stretched film was coated and dried in the same manner as in Example 19. Thereafter, the coated film was stretched 3.5 times in the transverse direction at 110° C. Further, the stretched film was subjected to heat setting at 215° C. for 5 seconds to obtain a film having a heat stick preventive coating of a thickness of 0.2 g/m$^2$ formed on the polyethylene terephthalate base film having a thickness of 5.7 μm. Further, a thermal ink ribbon was prepared and the property evaluation was conducted in the same manner as in Example 19. As a result, printing was excellent without sticking. On the other hand, the result of the storage test was also good.

EXAMPLE 23

A thermally sublimable ink ribbon was prepared in the same manner as in Example 22 except that a thermally sublimable ink was coated in a thickness of 1.5 g/m$^2$ The thermally sublimable ink used was composed of a disperse dye and a polyvinyl butyral resin, etc. using the ink ribbon thus obtained, a portrait was printed out by video printer VY-200 manufactured by Hitachi, Ltd. to evaluate the print out. As a result, no sticking phenomenon as between the ink ribbon and the thermal head was observed, and the obtained image had an excellent image quality.

The thermal transfer film obtained by the present invention is free from the sticking phenomenon, and the stick preventive coating layer is firmly bonded to the base film, whereby no transfer of the stick preventive coating layer to the non-treated surface of the ink layer is observed, and there will be no possibility that the ink layer is transferred to the rear surface of the laminate.

Further, the present invention is an in-line coating method as compared with conventional methods wherein only the base film is produced, and its economical effects are substantial.

We claim:

1. A film for a thermal transfer ink ribbon having excellent heat stick resistance, which comprises a base film made of a biaxially stretched thermoplastic resin film and a thermally meltable ink layer or a thermally sublimable ink layer formed on one side of the base film, wherein a thin layer composed of (A) a thermally reactive urethane prepolymer, (B) a fluorine polymer resin having a perfluoroalkyl group in its molecule, (C) a silicon compound having a hydroxyl group at each terminal of a dimethylpolysiloxane group, and (D) a polyvinyl alcohol having a saponification degree of at least 96 mol % and/or water-soluble starch, is formed on the other side of the base film at a rate of 0.05 to 0.5 g/m$^2$ as the total solid content of (A), (B), (C) and (D).

2. The film for a thermal transfer ink ribbon according to claim 1, wherein component (D), additionally comprises a modified polyvinyl alcohol having a carboxyl group in its molecule.

3. The film for a thermal transfer ink ribbon according to claim 1, wherein the thin layer is composed of at least 70 parts by weight of component (A), at least 20 parts by weight of component (B), at least 10 parts by weight of component (C) and at most 10 parts by weight of component (D), provided that the total amount of components (A), (B), (C) and (D) is at most 110 parts by weight.

4. The film for a thermal transfer ink ribbon according to claim 1, wherein the thermally reactive urethane prepolymer (A) contains free isocyanate groups blocked with a bisulfite.

5. The film for a thermal transfer ink ribbon according to claim 1, wherein the silicon compound (C) contains a structure of the formula:

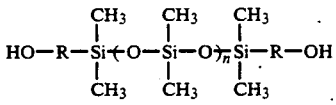

wherein R is an alkylene group having at least one carbon atom, and n is a positive integer.

6. The film for a thermal transfer ink ribbon according to claim 1, wherein the silicon compound (C) has an average molecular weight of from 500 to 5,000.

7. The film for a thermal transfer ink ribbon according to claim 1, wherein when component (D) is a polyvinyl alcohol, said polyvinyl alcohol has a degree of polymerization of at most 2,000.

* * * * *